United States Patent [19]

Christopoulos

[11] 3,967,468

[45] July 6, 1976

[54] CIRCULAR KNITTING MACHINE FOR PRODUCING INTERLOCK FABRIC

[75] Inventor: John Christopoulos, Charlotte, N.C.

[73] Assignee: The Singer Company, New York, N.Y.

[22] Filed: Oct. 14, 1975

[21] Appl. No.: 621,927

[52] U.S. Cl. ..... 66/20; 66/38
[51] Int. Cl.[2] ..... D04B 9/08
[58] Field of Search ..... 66/20, 25, 38, 196

[56] References Cited

UNITED STATES PATENTS

| | | | |
|---|---|---|---|
| 2,968,170 | 1/1961 | Wiesinger | 66/20 |
| 3,026,695 | 3/1962 | Philip | 66/20 |
| 3,387,466 | 6/1968 | Beckenstein | 66/38 |
| 3,456,460 | 7/1969 | Mishcon | 66/20 |

*Primary Examiner*—Mervin Stein
*Assistant Examiner*—A. M. Falik
*Attorney, Agent, or Firm*—Edward L. Bell; Robert E. Smith; William V. Ebs

[57] ABSTRACT

A cylinder and dial type circular knitting machine not operable in interlock gating because of interference between cylinder and dial needles is provided with needles and needle controlling camming enabling the machine to produce interlock fabric in interlock gating.

3 Claims, 4 Drawing Figures

CIRCULAR KNITTING MACHINE FOR PRODUCING INTERLOCK FABRIC

BACKGROUND OF THE INVENTION

1. Field of the Invention

The invention relates to cylinder and dial knitting machines capable of producing interlock fabric.

2. Description of the Prior Art

A cylinder and dial knitting machine of the kind shown in U.S. Pat. No. 3,552,150 issued Jan. 5, 1971 to L. Mishcon although capable of producing rib fabric at a very high rate of production has heretofore not been capable of producing interlock fabric in interlock gating because of interference between cylinder and dial needles when at the top of cylinder and dial raise cams respectively.

SUMMARY OF THE INVENTION

In order to render such machines capable of producing interlock fabric the cylinder and dial cams and the needles of the machine have been modified. In particular the maximum height of raise cams in both cylinder and dial cam sections have been made such as to avoid cylinder and dial needles interfering with one another when at the top of their respective raise cams although the machine is in interlock gating. The pattern wheels of such machines being inappropriately disposed to lift selected needles by reason of the modification to the raise cams have been eliminated and two types of cylinder needles, one having two butts, the lower one of which is shorter than the upper normal sized butt, and the other having only a lower normal sized butt, have been provided for actuation by the cylinder cams. In addition placer cams in alternate cylinder cam sections have been cut back and an additional raise cam has been provided in the other cylinder cam sections. The single butt cylinder needles are raised to latch clear yarn accepting positions in the alternate cylinder cam sections by the cut-back placer cams and they knit while in such cam sections whereas the double butt cylinder needles are raised to latch clear yarn accepting positions in the other cylinder cam sections by the additional raise cams and such double butt needles knit in these other cam sections. In the dial cam sections a dial needle knits whenever an aligned cylinder needle welts.

DESCRIPTION OF THE PREFERRED EMBODIMENT OF THE INVENTION

Figure 1:
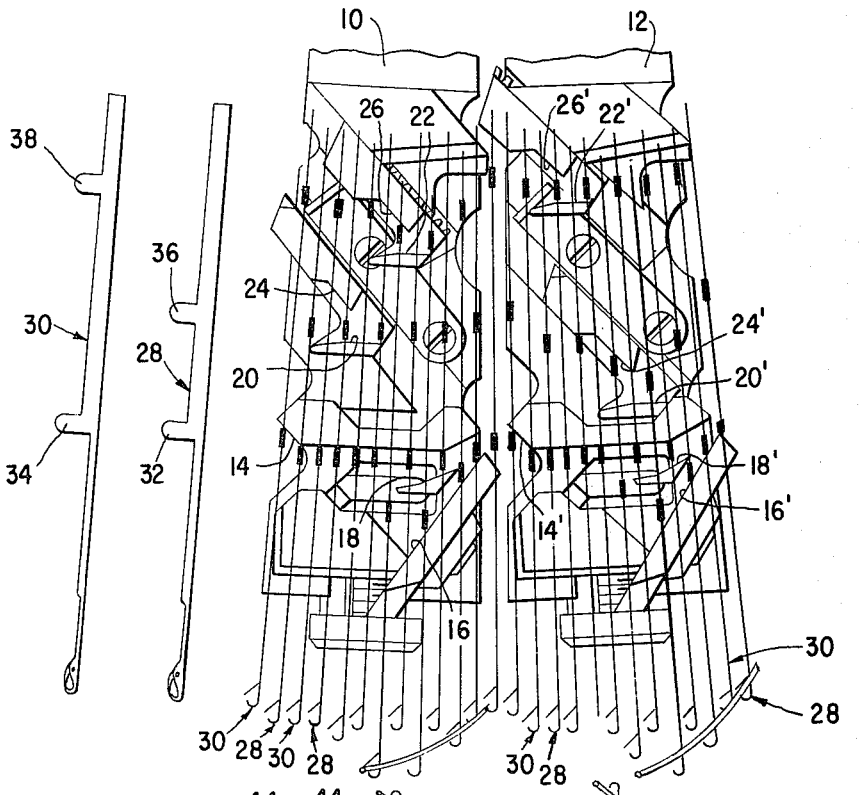
FIG. 1 is a bottom plan view showing dial cam sections and cooperating dial needles for two feeds of a circular knitting machine according to the invention.
Figure 2:
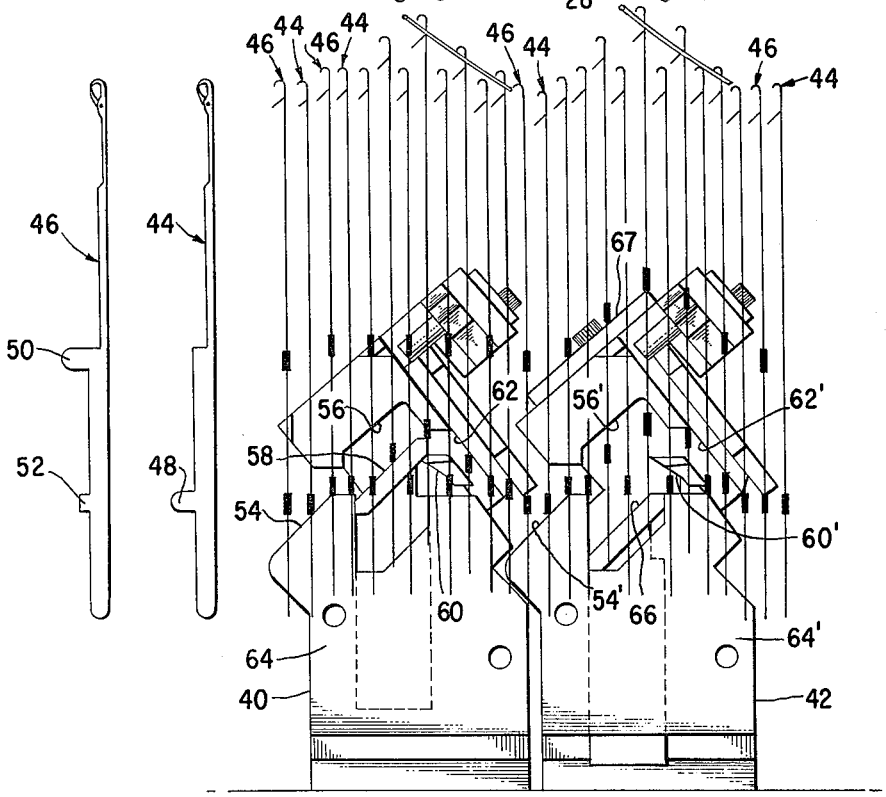
FIG. 2 is an inside elevational view showing the cylinder cam sections and cooperating needles according to the invention for the feeds of FIG. 1.

Referring to FIGS. 1 & 2 of the drawings, reference characters 10 and 12 designate adjacent dial cam sections of the type called for in U.S. Patent 3,552,150 and as shown in U.S. Patents 3,456,460 and 3,893,309. Dial cam section 10 includes a preliminary raise cam 14, a stitch cam 16, a wing cam 18, guard cams 20 and 22, an adjustable raise cam 24, and an adjustable raise cam 26. Dial cam section 12 includes preliminary raise cam 14', stitch cam 16', wing cam 18', guard cams 20' and 22', adjustable raise cam 24' and adjustable raise cam 26' respectively corresponding to the cams 14, 16, 18, 20, 22, 24 and 26 of cam section 10. Latch needles 28 and 30 having correspondingly located outer butts 32 and 34 respectively and differently located inner butts 36 and 38 respectively cooperate with the dial cams.

Figure 3:
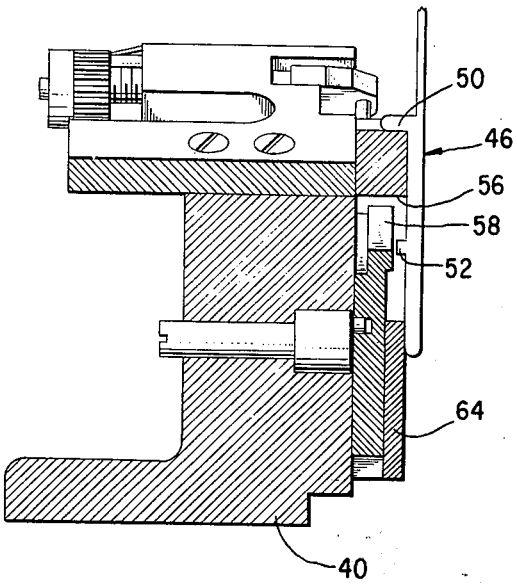
FIG. 3 is a sectional view showing one of the cam sections of FIG. 2 and a needle in its operating position in the cam section.
Figure 4:
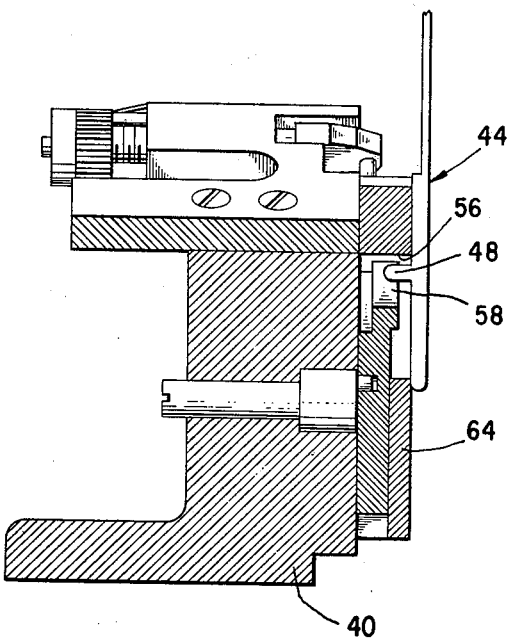
FIG. 4 is a sectional view also of the cam section of FIG. 3 but showing a different needle in the cam section.

Reference characters 40 and 42 designate cylinder cam sections associated with the dial cam sections 10 and 12 respectively and including cams that control cylinder needles 44 and 46, the needles 44 and 46 being aligned with the dial needles 28 and 30 respectively. Needles 44 have one normal sized butt 48 whereas each of the needles 46 has two butts, an upper normal sized butt 50 and a lower short butt 52. The lower butts 52 of the needles 46 and butts 48 of the needle 44 are correspondingly located as shown. Cam section 40 includes a raise cam 54, a guard cam 56, an adjustable placer cam 58, a wing cam 60 and a stitch cam 62, which correspond to the cylinder cams of U.S. Pat. No. 3,552,150 except for placer cam 58 which differs from the placer cam of the patent in that it is cut-back with respect to the cam face 64 sufficiently to avoid engagement with the short butts 52 of needles 46, but not enough to avoid engagement with butts 48 on the needles 44 (See FIGS. 3 and 4). Cam section 42 includes raise cam 54', guard cam 56', wing cam 60' and stitch cam 62' corresponding to the raise cam 54, guard cam 56, wing cam 60, and stitch cam 62 respectively of cam section 40. The cam section 42 also includes a conventional adjustable placer cam 66 which is flush with the cam face 64', and additionally includes a raise cam 67.

In order to provide for the knitting of interlock fabric the raise cams 26 and 24' in dial cam sections 10 and 12 respectively are disposed in fully extended positions and the raise cams 24 and 26' in such cam sections are disposed in fully retracted positions. Placer cam 58 in cylinder cam section 40 is fully extended and placer cam 66 in cylinder cam section 42 is fully retracted. The cylinder needles 48 and 52 are aligned with dial needles 28 and 30 respectively, as shown, for interlock knitting.

The dial and cylinder needles, the different types of which alternate in the cylinder and dial of the machines, move in the direction indicated through the cam sections of FIGS. 1 and 2 and other like cam sections of a machine adapted according to the invention to produce interlock fabric. Dial needles 28 are raised in cam section 10 of the engagement of needle butts 32 with preliminary raise cam 14 but only to a welting height. They are not otherwise raised in cams section 10 because butts 36 of the needles do not contact raise cam 24 which is fully retracted. The needles 28 therefore move through a cam section 10 at welting height. Needles, 30, each of which enters cam section 10 immediately after a needle 28, are preliminarily raised by the engagement of butts 34 with raise cam 14 after which they are further raised to a latch clear yarn accepting position by the engagement of butts 38 with raise cam 26. The needles 30 after having been raised to a latch clear position are drawn to a cast-off position and thereby caused to knit by engagement of butts 34 with stitch cam 16. In cam section 12 needles 28 are preliminarily raised by the engagement of butts 32 with raise cam 14' and are further raised to a latch clear yarn accepting position by the engagement of butt 36 with raise cam 24'. Such needles 28 are then drawn to a cast-off position by stitch cam 16' and knit. Needles 30 are raised by engagement of butts 34 with raise cams 14' to a welting position in cam section 12 and remain at a welting level throughout the cam section.

The cylinder needles 44 are preliminarily raised in cylinder cam section 40 by the engagement of the butts 48 with raise cam 54 and are thereafter raised to a latch clear yarn accepting position by the engagement of the butts 48 with placer cam 58. Needles 44 are then drawn to a cast-off position by stitch cam 62 and knit. In cam section 42 the needles 44 are raised by engagement of butts 48 with raise cam 54' to a welting position and they remain at a welting height throughout the cam section because the placer cam in cam section 42 is in a fully retracted position. Needles 46 are raised in cam section 40 by the engagement of butts 52 with raise cam 54 to a welting height and they remain at a welting height throughout the cam section since the butts 52 miss cut-back placer cam 58. The needles 46 are preliminarily raised in the cam section 42 by the engagement of butts 52 with raise cam 54' and are then further raised to a latch clear yarn accepting position by the engagement of butts 50 with raise cam 67 after which such needles are drawn to a cast-off position by stitch cam 62' acting on butts 52 and knit.

In other words the dial needles 28 welt in dial section 10 while aligned cylinder needles 44 knit in cylinder cam section 40, whereas needles 28 knit in dial cam section 12 while needles 44 welt in cam section 40. Dial needles 30 knit in dial cam section 10 knit while aligned cylinder needles 46 welt in cylinder cam section 40 whereas needles 30 welt in dial section cam 12 while dial needles 46 knit in cylinder cam section 42. The dial and cylinder needles are similarly controlled in other cam sections (not shown) to provide for the production of interlock fabric.

Although the invention has been described in its preferred form with a certain degree of particularity, it is understood that the present disclosure of the preferred form has been made by way of example and the numerous changes in the details of construction and the combination and arrangement of parts may be resorted to without departing from the spirit and the scope of the invention.

Having thus set forth the nature of the invention, what is claimed herein is:

1. In a multi-feed cylinder and dial circular knitting machine, a plurality of like multi-butt cylinder needles, a plurality of like single-butt cylinder needles which alternate in space with the multi-butt needles, a first butt on each of the multi-butt needles and the single butt on each of the other needles being correspondingly located with respect to yarn engaging ends of the respective needles, needle actuating cam means relatively movable with respect to the cylinder needles including a cam to engage the butt on each of the single-butt needles and raise such needles for the taking of yarn at the first of a pair of successive yarn feeds, whereby the single-butt needles may knit at said first feed, the said first butt of the multi-butt needles being shorter than the one butt of the single-butt needles such that said cam is missed by the shorter butts of the multi-butt needles and the multi-butt needles welt at said first yarn feed, said needle actuating cam means also including camming causing the multi-butt cylinder needles to knit at the second of the successive yarn feeds and the single-butt needles to welt at the second yarn feed, a plurality of like multi-butt dial needles aligned with the single-butt cylinder needles, a plurality of other like multi-butt dial needles, aligned with the multi-butt cylinder needles, and needle actuating dial camming relatively movable with respect to the dial needles for causing the dial needles aligned with the single-butt cylinder needles to welt at the first feed and knit at the second and for causing the dial needles aligned with the double-butt cylinder needles to knit at the first feed and welt at the second.

2. The combination of claim 1 wherein the cam which misses the short butt of the multi-butt cylinder needles is recessed in the first mentioned cam means.

3. The combination of claim 1 wherein the camming causing the multi-butt cylinder needles to knit at the second feed includes a raise cam to engage the longer butt of these needles.

* * * * *